United States Patent [19]

Nijman et al.

[11] 4,162,469

[45] Jul. 24, 1979

[54] COAXIAL SWITCH WITH MAGNETIC LOCKING

[75] Inventors: John P. Nijman, Wheaton, Ill.; Kamal S. Boutros, Toronto, Canada

[73] Assignee: Bunker Ramo Corporation, Oak Brook, Ill.

[21] Appl. No.: 799,672

[22] Filed: May 23, 1977

[51] Int. Cl.[2] ..... H01H 3/56

[52] U.S. Cl. ..... 335/186; 335/5

[58] Field of Search ..... 335/1, 5, 4, 186, 253, 335/164, 238, 140, 121, 72; 70/276; 333/97 S; 200/44

[56] References Cited

U.S. PATENT DOCUMENTS 4,051,702 10/1977 Treschitta ..... 70/276

*Primary Examiner*—Harold Broome

*Attorney, Agent, or Firm*—William Lohff; F. M. Arbuckle

[57] ABSTRACT

A magnetically-locked switch assembly includes a switch unit having internal contact means positioned by an actuator arm between open and closed positions. Unauthorized actuation of the actuator arm is prevented by a locking pin which is displaced to release the actuator arm only in the presence of an externally applied magnetic field. The actuator arm is mechanically actuated from outside the switch housing through a slip-clutch to prevent damage to the actuator arm by application of excessive force when the actuator arm is locked.

7 Claims, 9 Drawing Figures

COAXIAL SWITCH WITH MAGNETIC LOCKING

BACKGROUND OF THE INVENTION

The present invention relates generally to electric switches, and more particularly to a weather-proof coaxial switch assembly having a magnetic locking feature which prevents unauthorized actuation.

In cable antenna television (CATV) systems radio frequency (RF) signals are transmitted to the TV receivers of individual subscribers by means of a coaxial cable. In order to provide a means by which service can be terminated to a subscriber various switch assemblies have been proposed for insertion in the line to the subscriber to interrupt transmission and to substitute a passive termination corresponding to the characteristic impedance of the coaxial cable. These assemblies have been both of a type intended for actuation by an electrical control signal from a central office, as described in copending application Ser. No. 741,606, filed Nov. 15, 1976, and assigned to the present assignee, and of a type intended for manual actuation by service personnel, as described in the copending application Ser. No. 599,692, filed July 28, 1975, and also assigned to the present assignee.

One requirement of coaxial switches of the latter manually-actuated type is that they be secure against unauthorized actuation, since such switches are often installed in or on utility poles, or in utility boxes or other accessible locations wherein they are available for operation by servicemen for either connecting or disconnecting the CATV cable to the subscriber depending on whether the service is desired or has been paid for. Another requirement of such switches is that the locking arrangement utilized therein provide reliable operation even after exposure to weather for long periods of time, and without the need for periodic maintenance. It is for this reason that magnetic locking arrangements, wherein the switch is unlocked by means of a magnetic-key unit such as in the aforementioned application Ser. No. 599,692, instead of by a tumbler and cylinder type lock susceptible to corrosion, are preferred for such applications. The present invention provides an improved construction for such a magnetically-locked switch which provides improved performance and is less expensive to construct.

Accordingly, it is a general object of the present invention to provide a new and improved magnetically-locked coaxial switch.

It is another object of the present invention to provide a new and improved magnetically-locked coaxial switch which provides improved performance and is less costly to manufacture.

SUMMARY OF THE INVENTION

The invention is directed to a magnetically-locked switch assembly which comprises a switch unit housing defining an interior chamber, input and output connectors communicating with the chamber, and contact means within the chamber having a first position establishing electrical connection between the input and output connectors, and a second position providing electrical isolation between the input and output connectors. Actuating means including a contact actuator member and an externally accessible member are provided for positioning the contact means in a selected one of the first and second positions, and magnetic locking means in the chamber physically inaccessible from the exterior of the housing and responsive to an externally-applied magnetic field are provided for preventing actuation of the contact actuator member between the open and closed positions in the absence of the field. Clutch means disposed between the externally accessible member and the contact actuator member prevent the application of force sufficient to damage the contact actuator member when actuation thereof is prevented by the magnetic locking means.

BRIEF DESCRIPTION OF THE DRAWINGS

The novel features which are believed to be characteristic of the invention are set forth in the appended claims. The invention itself, however, together with further objects and advantages thereof, will be best understood by reference to the following description taken in conjunction with the accompanying drawings, in which:

DESCRIPTION OF THE PREFERRED EMBODIMENT

Figure 1:
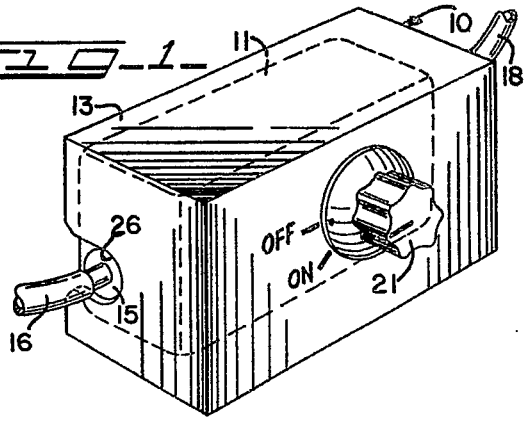
FIG. 1 is a perspective view of a magnetically-locked coaxial switch constructed in accordance with the invention showing the magnetic key unit thereof in position for actuation of the switch.
Figure 3:
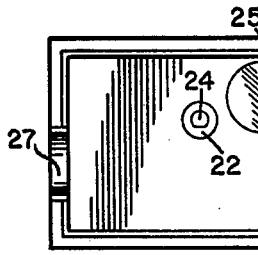
FIG. 3 is a rear elevational view of the magnetic key unit showing the mechanical and magnetic coupling provisions thereof.
Figure 2:
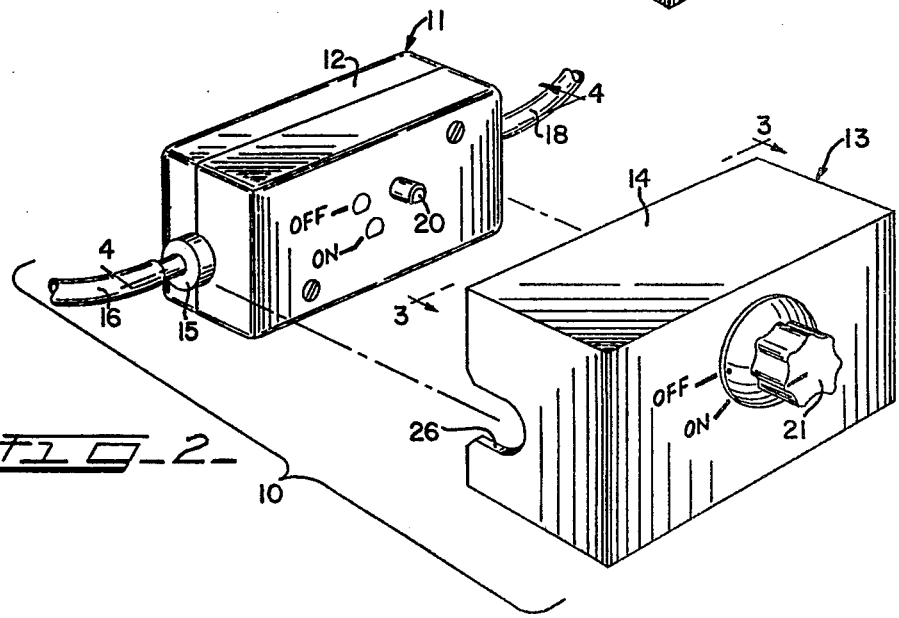
FIG. 2 is a perspective view of the magnetically-locked coaxial switch of FIG. 1 showing the key unit separated from the switch unit.

Referring to the figures, and in particular to FIGS. 1–3, a magnetically-locked coaxial switch assembly incorporating the principles of the present invention is indicated generally by the reference character 10. The switch assembly 10 includes a switch unit 11 having a generally rectangular two-section enclosure or housing 12, and a magnetic key unit 13 having a similarly shaped enclosure or housing 14. The switch unit housing 12 is formed of a non-magnetic material such as a hard plastic or a die cast metal and may be provided with apertured ears (not shown) for mounting to a support structure. The switch unit housing 12 includes on one end a coaxial fitting 15 for receiving a first coaxial cable segment 16 through which RF signals are conveyed into the switch, and a second coaxial fitting 17 (FIG. 4) for receiving a second coaxial cable segment 18 through which RF signals are conveyed from the switch to the subscriber. The key unit housing 14, which is dimensioned to fit in overlapping relationship to the front, top and side surfaces of switch unit housing 12, is also formed of a non-magnetic material such as hard plastic or a die cast metal.

An actuator shaft 20 extending through the front surface of switch unit housing 12 enables the switch assembly to be conditioned to open and closed positions as desired. Actuation of this shaft is accomplished by the user by means of an actuator knob 21 on the front surface of key unit 13. This knob is mounted on a shaft segment 22 (FIG. 3) which extends through the key unit to the rear surface 23 of the key unit housing, where an axially-extending recess 24 including a flat keying surface is provided in the end of the shaft for telescopingly receiving the exposed and complementarily-keyed end of actuator shaft 20. The key unit also includes a magnetic field source in the form of a permanent magnet 25 which unlocks the switch unit when the key unit is in position. Recesses 26 and 27 in the sidewalls of the key unit housing provide clearance for connectors 15 and 17 when units 11 and 12 are engaged.

Figure 4:
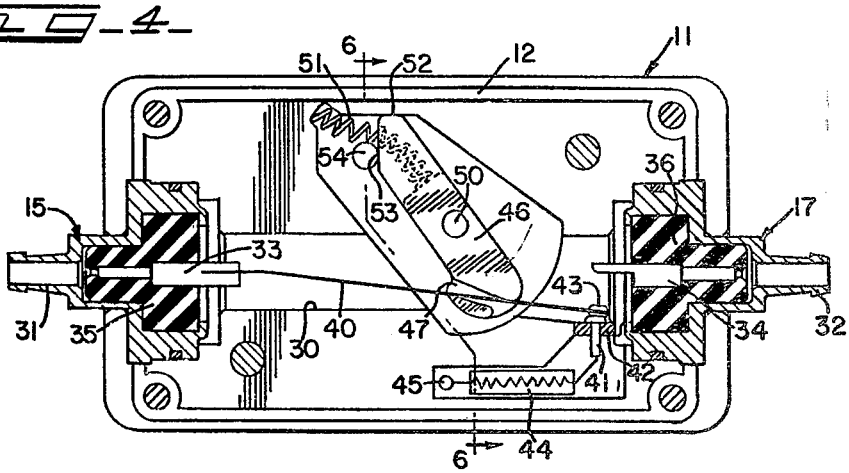
FIG. 4 is a cross-sectional view of the coaxial switch taken along line 4—4 of FIG. 2 showing the switch in an open position with its input terminated.
Figure 5:
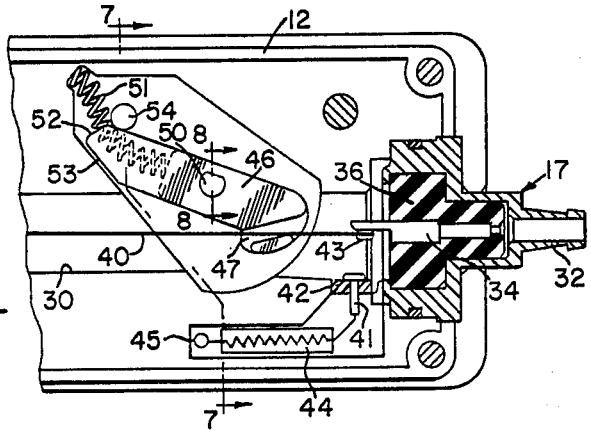
FIG. 5 is a partial cross-sectional view similar to FIG. 4 showing the switch in a closed position with its input connected to its output.

Referring to FIGS. 4 and 5, the two sections of housing 12 of switch unit 11 define an interior cavity 30. Coaxial connectors 15 and 17 each include respective electrically conductive body portions 31 and 32 projecting from the switch unit housing for receiving the outer conductor of a coaxial cable, respective electrically conductive center contact portions 33 and 34 for receiving the center conductor of a coaxial cable, and respective dielectric insert portions 35 and 36 for supporting and electrically isolating the center contact portions. Connector 15 connects, for example, to a subscriber distribution cable while connector 17 connects to a cable leading to the subscriber's television receiver. A ground connection is provided between the connectors by either forming housing 12 of an electrically-conductive material or by providing an electrically-conductive shield within the housing between the connectors.

A conductive bridging member or metal switch pole 40, which comprises a spring contact fixedly attached at one end to the center conductor 33 of coax connector 15, electrically connects the center conductor to either the center conductor 34 of coax connector 17, or to a stationary contact 41 mounted within housing 12 by means of an electrically non-conductive support 42. The free end of the spring contact 40 is fitted with a contact portion 43 which engages either the center contact 34 or the stationary contact 41. The stationary contact 41 is connected to the electrically-conductive housing 12 at point 45 by means of an impedance 44, which in practice is selected to correspond to the characteristic impedance of coaxial cable segment 16 so that when the switch unit 11 is open the incoming line is properly terminated.

Spring contact 40 is biased into engagement with either center contact portion 34 or stationary contact 41 by means of an actuator arm 46 pivotably mounted within cavity 30. Actuator arm 46 includes a slot-like recess 47 at one end within which the spring contact 40 is received. When actuator member 46 is rotated to a clockwise position, as shown in FIG. 4, spring contact 40 is biased to establish electrical connection with contact 41. This is the open position of switch unit 11 in which the input coaxial cable segment is terminated by impedance 44. When actuator member 46 is rotated counterclockwise as shown in FIG. 5, the switch unit is in its closed position and spring contact 40 is biased against the center contact 34 of connector 17 to establish an electrical connection between coaxial cable segments 16 and 18.

The actuator arm 46 is mounted on and rotatably coupled to a stub shaft 50 and is biased into either its clockwise or counterclockwise position by means of a helical compression spring 51 fixedly attached at one end to the actuator arm and fixedly attached at its other end to housing 12. This spring is preferably maintained under partial compression so as to flex to either one side or the other of arm 46, thereby providing an over-center toggling action. A first inclined edge portion 52 on actuator arm 46 provides a positive stop for the arm in its clockwise direction, as shown in FIG. 4, and a second edge portion 53 provides a positive stop for the arm in its counterclockwise position, as shown in FIG. 5.

Figure 6:
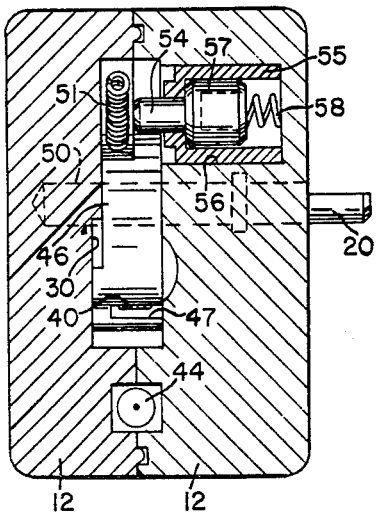
FIG. 6 is a cross-sectional view of the switch taken along line 6—6 of FIG. 4.

In accordance with one aspect of the invention, actuator arm 46 is locked in either its clockwise or counterclockwise position by means of a locking pin 54 mounted for reciprocative movement in a direction transverse to the plane of rotation of arm 46. Referring to FIG. 6, locking pin 54 is slidably mounted within a cylindrical collar 55 which is seated within a recess 56 provided in the front section of housing 12. Locking pin 54 includes a magnetized portion 57 of increased diameter at one end and is biased so as to interfere at its other end with rotation of actuator arm 46 by means of a helical compression spring 58.

In the normal locked condition of switch unit 11 spring 58 biases the locking pin into an interference relationship with actuator arm 46 whereby rotation of the actuator member from either its closed clockwise position or open counterclockwise position is prvented. This is shown in FIG. 6. However, when key unit 13 is engaged to switch unit 11, as in FIG. 7, the permanent magnet 25 within the key unit produces a magnetic field which attracts the magnetic portion 57 of the locking pin. The force of this is sufficient to overcome the bias of spring 58 and pull the pin out of its interfering relationship with actuator arm 46. The actuator arm is then free to rotate between its clockwise and counterclockwise positions to provide the desired positioning of contact arm 40.

Figure 8:
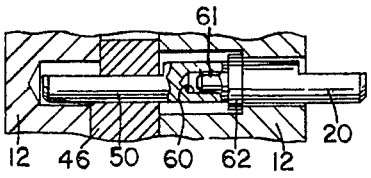
FIG. 8 is a cross-sectional view of one construction for the clutch assembly utilized in conjunction with the actuator shaft of the switch.
Figure 9:
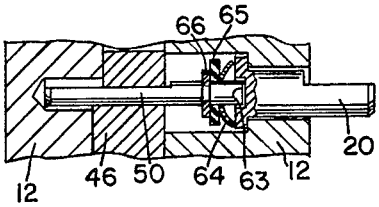
FIG. 9 is a cross-sectional view of an alternate construction for the clutch assembly utilized in conjunction with the actuator shaft of the switch.

In accordance with another aspect of the invention, a slip-clutch rotational coupling is provided between the externally-accessible shaft segment 20 of switch unit 11 and the shaft segment 50 on which actuator arm 46 is mounted to prevent damage to the switch from excessive force being applied to actuator arm 46 when the actuator arm is locked by pin 54. Referring to FIG. 8, in one form the slip-clutch coupling may be obtained by means of an axially-extending aperture 60 in the end of shaft segment 50 within which a shank portion 61 of reduced diameter on the inside end of shaft segment 20 is frictionally fitted. A collar portion 62 of increased diameter on shaft segment 20 prevents segment 20 from being pulled from the housing.

In an alternate embodiment of the slip-clutch coupling, shaft segment 50 is received within a recess 63 provided on the end of shaft segment 20. Rotational coupling is obtained between the two shaft segments by means of a convex washer 64, a C washer 66, and a resilient washer 65 compressed between washers 64 and 66.

The two housing sections 13 form an enclosure for the coaxial cable connectors and their electrical interconnections which render these elements inaccessible without disassembly of the switch unit housing. Normally, such disassembly is avoided by either permanently bonding the two housing sections together, or by joining the housing sections by means of special fasteners requiring special tools for engagement.

Figure 7:
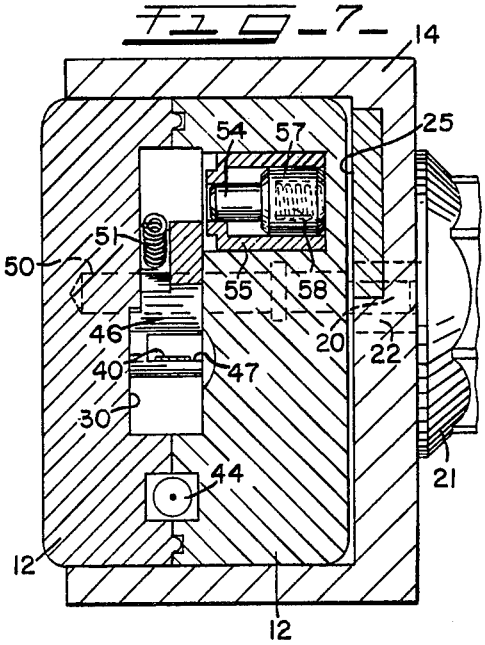
FIG. 7 is a cross-sectional view of the switch with magnetic key unit in position taken along line 7—7 of FIG. 5.

In use, the switch unit 11 is conditioned to either an open or a closed state by engaging the key unit 13 to the switch unit 11, as shown in FIGS. 1 and 7. This simultaneously displaces pin 54 to unlock actuator arm 46, and rotatably couples the arm to the user-accessible knob 21. All that remains is for the user to rotate the knob to the desired position, as indicated by indices on the key unit housing. Any misalignment of shaft segment 20 prior to engagement of the switch and lock units, such as might result from slippage of the internal clutch during attempted actuation of the switch without release of the magnetic locking pin, is easily corrected by aligning the flat (or other shaft alignment key) as shown by indices on the switch unit housing prior to engagement of the key unit.

Thus, applicant has provided a magnetically-locking coax switch assembly which avoids the use of tumbler and cylinder-type lock assemblies while providing protection against unauthorized actuation. The switch assembly is relatively inexpensive to manufacture and capable of providing reliable service even after long-term exposure to weather, making it ideally suited for CATV and similar applications wherein a large number of switch assemblies are required.

While a particular embodiment of the invention has been shown and described, it will be appreciated that changes and modifications may be made therein without departing from the true spirit and scope of the invention. It is, therefore, intended that all such changes and modifications be covered by the following claims.

I claim:

1. A magnetically-locked switch assembly comprising, in combination:

a switch unit housing defining an interior chamber;

an input connector communicating with said chamber;

an output connector communicating with said chamber;

contact means within said chamber having a first position establishing electrical connection between said input connector and said output connector, and a second position providing electrical isolation between said input connector and said output connector;

actuating means including a contact actuator member and an externally accessible member for positioning said contact means in a selected one of said first and second positions;

magnetic locking means in said chamber physically inaccessible from the exterior of said housing and responsive to an externally-applied magnetic field for preventing actuation of said contact actuator member between said first and second positions in the absence of said field; and clutch means disposed between said externally accessible member and said contact actuator member for preventing the application of sufficient force to damage said contact actuator member when actuation thereof is prevented by said magnetic locking means.

2. A magnetically-locked switch assembly as defined in claim 1 wherein said actuator member is pivotally mounted within said housing in operative engagement with said contact means, and wherein said actuating means includes a first shaft segment cooperating with said contact actuator member within said housing nonaccessible from the exterior thereof and a second shaft segment extending through said housing and cooperating with said externally accessible member, and wherein said clutch means comprise a slip-clutch disposed between and rotatably coupling said first and second shaft segments.

3. A magnetically-locked switch assembly as defined in claim 2 wherein said magnetic locking means include a locking pin slidably mounted within said chamber and spring-biased into a first position physically blocking movement of said contact positioning member, and a second position allowing free movement of said contact positioning member.

4. A magnetically-locked switch assembly as defined in in claim 3 wherein said locking pin is magnetically polarized, and wherein at least a portion of said housing is magnetically permeable to facilitate positioning of said locking pin by said applied external magnetic field

5. A magnetically-locked switch assembly as defined in claim 1 wherein said actuating means include toggling means for spring-biasing said contact actuator member in said first and second positions.

6. A magnetically-locked switch assembly as defined in claim 1 which further comprises a key unit including a housing adapted for engagement with said switch unit housing; and means including a magnet disposed within said housing for applying a magnetic field to said locking means whereby said contact means are actuable between said first and second positions when said housings are engaged.

7. A magnetically-locked switch assembly as defined in claim 6 wherein said key unit includes user-accessible actuator means mechanically coupled to said externally accessible member for actuating said contact actuator member when said housings are engaged.

* * * * *